US008915017B2

(12) United States Patent
Linnenkohl

(10) Patent No.: US 8,915,017 B2
(45) Date of Patent: Dec. 23, 2014

(54) DRIVE DEVICE FOR ENTRANCE AND EXIT DEVICES COMPRISING A SAFETY COUPLING

(75) Inventor: Lars Linnenkohl, Staufenberg (DE)

(73) Assignee: GEBR, BODE GmbH & Co. KG, Kassel (DE)

( * ) Notice: Subject to any disclaimer, the term of this patent is extended or adjusted under 35 U.S.C. 154(b) by 0 days.

(21) Appl. No.: 13/513,527

(22) PCT Filed: Jun. 24, 2010

(86) PCT No.: PCT/EP2010/059003

§ 371 (c)(1),
(2), (4) Date: Jun. 1, 2012

(87) PCT Pub. No.: WO2011/067001

PCT Pub. Date: Jun. 9, 2011

(65) Prior Publication Data

US 2012/0233925 A1 Sep. 20, 2012

(30) Foreign Application Priority Data

Dec. 3, 2009 (DE) ..... 20 2009 016 351 U
Dec. 29, 2009 (DE) ..... 20 2009 017 683 U

(51) Int. Cl.
*E05F 15/02* (2006.01)

(Continued)

(52) U.S. Cl.
CPC ..... *E05F 15/0017* (2013.01); *E05F 15/10* (2013.01); *E05F 15/121* (2013.01);

(Continued)

(58) Field of Classification Search
CPC ..... B60J 5/04; B60J 5/062; E05F 15/00; E05F 15/0013; E05F 15/10; E05F 15/12; E05F 15/121; E05F 15/127
USPC ..... 49/333, 334, 335, 338; 192/56.62; 464/36; 296/146.4
See application file for complete search history.

(56) References Cited

U.S. PATENT DOCUMENTS 4,282,686 A * 8/1981 Britzke et al. ..... 49/253
4,308,691 A * 1/1982 Horn ..... 49/255

(Continued)

FOREIGN PATENT DOCUMENTS

DE 203 16 764 U1 3/2005
DE 20 2008 007 585 U1 4/2009

(Continued)

OTHER PUBLICATIONS

International Search Report for International Application No. PCT/EP2010/059003.

*Primary Examiner* — Katherine Mitchell
*Assistant Examiner* — Catherine A Kelly
(74) *Attorney, Agent, or Firm* — McCarter & English LLP

(57) ABSTRACT

The invention relates to a drive device (20) for entrance and exit devices for public transportation vehicles, comprising a drive unit (22) that is arranged in and drives a rotary column (24) rotating about a rotational axis Z-Z during opening and closing operations, said column opening and closing the entrance and exit device. The drive unit (22) is held on the vehicle via a retaining component (40). The retaining component (40) acts as counter bearing for a torque of the drive unit (22). Between the drive unit (22) and the retaining component (40), a coupling device (72) is arranged, which enables a rotation of the drive unit (22) about the rotational axis Z-Z when a threshold value of the torque acting upon the drive unit is exceeded. Between the coupling device (72) and the retaining component (40), a bearing is provided, which enables a tumbling motion of the rotary column (24) with the coupling device (72) and prevents a rotation about the rotational axis Z-Z.

13 Claims, 12 Drawing Sheets

(51) Int. Cl.
*E05F 15/00* (2006.01)
*E05F 15/10* (2006.01)
*E05F 15/12* (2006.01)

(52) U.S. Cl.
CPC ..... *E05F 15/127* (2013.01); *E05Y 2201/214* (2013.01); *E05Y 2201/216* (2013.01); *E05Y 2201/236* (2013.01); *E05Y 2201/422* (2013.01); *E05Y 2201/434* (2013.01); *E05Y 2201/636* (2013.01); *E05Y 2400/86* (2013.01); *E05Y 2800/25* (2013.01); *E05Y 2800/252* (2013.01); *E05Y 2800/262* (2013.01); *E05Y 2900/51* (2013.01); *E05F 15/00* (2013.01)
USPC ..... 49/334; 49/333; 296/146.4

(56) References Cited

U.S. PATENT DOCUMENTS 4,490,941 A * 1/1985 Mamach ..... 49/28
4,731,886 A * 3/1988 Heinrich et al. ..... 49/334
6,312,339 B1 * 11/2001 Beyert ..... 464/30
6,553,717 B2 * 4/2003 St. John et al. ..... 49/340
7,017,974 B2 * 3/2006 Tong et al. ..... 296/146.4
7,367,161 B1 * 5/2008 Jones ..... 49/334
8,448,383 B2 * 5/2013 Bode ..... 49/334
2003/0051966 A1 * 3/2003 Sproatt et al. ..... 192/56.55
2010/0295542 A1 * 11/2010 Pellegrini ..... 324/207.25

FOREIGN PATENT DOCUMENTS

DE 20 2008 001 066 U1 6/2009
EP 1 040 979 A2 10/2000
EP 1 314 626 A1 5/2003
EP 1 527 975 A1 5/2005
IT 1 132 414 B 7/1986

* cited by examiner

DRIVE DEVICE FOR ENTRANCE AND EXIT DEVICES COMPRISING A SAFETY COUPLING

CROSS-REFERENCE TO RELATED APPLICATIONS

This application is the U.S. National Phase of International Application No. PCT/EP2010/059003, entitled "Drive Device for Entrance and Exit Devices Comprising a Safety Coupling," filed Jun. 24, 2010, and claiming priority to German Patent Applications DE 20 2009 016 351.2, filed Dec. 3, 2009, and DE 20 2009 017 683.5, filed Dec. 29, 2009, the disclosures of which are hereby incorporated by reference in their entireties.

FIELD OF THE INVENTION

The invention relates to a drive device for entrance and exit devices for public transportation vehicles.

BACKGROUND OF THE INVENTION

Such entrance and exit devices are known per se in particular for passenger doors, but also for entrance ramps, sliding steps and suchlike on public transportation vehicles. These are often arranged in the region of the door frames or door portals above a passage opening. For example, pivot sliding doors are described in EP 10 409 79 A2 and EP 13 146 26 A1. The drives which are shown therein are therefore suitable in particular for pivot sliding doors, which carry out a pivoting and a lateral displacement during the opening and closing process. Also drive devices for purely rotating or pivoting doors, i.e. doors which do not carry out a lateral displacement, are generally arranged above or below the doors in the region of the door portal. DE 203 16 764 U1 describes the arrangement of a drive device in the upper region of the door portal.

A disadvantage in these drive devices is always that they require considerable structural space. It has also been found that the mounting and adjusting of such drive devices and doors is very time-consuming.

A drive device in particular for passenger doors which is of very compact construction is known from DE 20 2008 007 585 U1. By its narrow and elongate construction, it is possible to integrate the drive device into a rotary column of a passenger door. In addition to a saving of space, the accommodating of the drive unit directly in the rotary column also has several advantages with regard to maintenance and installation of the entire drive device. In addition to this is the fact that the drive device, through a special mounting, is largely kept free of stresses through movements of the vehicle, of the portal or of the rotary column.

However, a problem also exists in such compact drive systems in that when, in the opened or closed state, greater external forces are applied on, for example, the door leaves, very large forces are exerted via the lever arms of the door system onto the drive unit and the gear unit of the drive device. These forces occur in particular in the case of vandalism or during opening and closing processes in overcrowded vehicles and can even lead to damage to the drive or to the gear unit when initiated abruptly, e.g. on the opened door leaf.

SUMMARY OF THE INVENTION

The invention is based on the problem of providing a drive device of the type described in the introduction, which is not damaged even in the case of excessively great torques which act on entrance and exit devices, in particular on passenger doors. The drive device is to be constructed here so as to be as robust and stable as possible, and the production and installation are to be possible in a simple and favourably priced manner. It is also essential that the drive device is not damaged by movements of the vehicle or of the rotary column which are normal in operation.

The problem is solved according to the invention by a drive device for entrance and exit devices for public transportation vehicles, comprising a drive unit that is arranged in and drives a rotary column rotating about a rotational axis Z-Z during opening and closing operations, said column opening and closing the entrance and exit device, wherein the drive unit is held on the vehicle via a retaining component and the retaining component acts as a counter bearing for a torque of the drive unit, wherein between the drive unit and the retaining component a coupling device is arranged, which enables a rotation of the drive unit about the rotational axis Z-Z when a threshold value of the torque acting upon the drive unit is exceeded, and between the coupling device and the retaining component a bearing is provided which enables a tumbling motion of the rotary column with the coupling device and prevents a rotation about the rotational axis Z-Z.

In such an arrangement, a counter bearing is opposed to the applied torque, in that the drive unit is fastened to a fixed component of the vehicle. It is thus possible that the output torque of the drive device can be transferred to the rotary column and that the latter rotates.

According to the invention, a bearing of the drive device or respectively drive unit is provided, which takes into account that owing to the length of the rotary column, twists and deflections thereof can scarcely be avoided during operation. The movements of the rotary column are brought about for example in that the vehicle is compressed or twisted owing to accelerating and braking processes and travelling around corners. In buses, the contact of tyres with kerbstones or similar edges also leads to the fact that a vehicle deformation and hence a movement of the rotary column occurs. As the drive unit is secured on a fixed component, such twists and deflections of the rotary column can have a negative effect on the drive device. The drive unit is therefore connected with the retaining component via a bearing, which enables a tumbling motion of the rotary column, but prevents a rotation about the rotational axis Z-Z. A tumbling motion is understood to mean a deflection from the rotational axis Z-Z in the X and/or Y direction. This function compensates, as it were, a relative movement between the drive unit and the column.

Advantageously in addition a movement in the Z direction, i.e. in the direction of the rotational axis Z-Z is possible, in order to balance out a change in length by compressions or extensions of the rotary column. For this purpose, a guide shaft which connects the drive unit with the bearing is mounted displaceably in a guide of the bearing. For transferring the torque, the guide shaft is preferably non-circular; it may, for example, have a multi-edged or polygonal geometry.

For the function of the coupling device, it is crucial that it is arranged functionally between the retaining component and the drive unit; theoretically, it could accordingly also be positioned above the bearing, i.e. between the retaining component and the bearing. However, the arrangement of the bearing according to the invention between the coupling device and the retaining component has the essential advantage that the degrees of freedom of movement brought about by the bearing not only protect the rotary column, but also the coupling device, from damage and wear. The ability of the rotary column to carry out a tumbling motion with the drive device and the coupling device is brought about, as it were, at the highest point, already immediately in the region of the fastening of the rotary column with the associated components already on the retaining component or respectively portal. In addition to this is the fact that this arrangement is able to be realized with only relative few and robust components. The space requirement is small and the bearing only has a small amount of play.

The movable and flexible mounting of the drive device or respectively drive unit enables the installation of the drive device into different vehicles. It is even conceivable to use the drive device in a rotary column with a small inclination, for example an oblique position of up to 5°. The movable mounting also assists in balancing out installation tolerances, which facilitates the installation and maintenance of the entire drive device.

The drive device or respectively the gear unit is protected in that the entire drive unit co-rotates starting from a particular torque and damage is thus avoided. However, it is crucial that the coupling device only uncouples when a torque acting on the drive unit exceeds a threshold value, but the torques necessary for a normal operation are transferred without a problem. The coupling device therefore serves as a security coupling for the drive unit or respectively for the gear unit.

The coupling device can be constructed as a slip coupling, however a hydrodynamic or electrodynamic coupling is also conceivable. Also, a so-called breaking pin coupling can be used, in which pins break on reaching the threshold torque. This embodiment is certainly expedient for particular cases of application, but has the disadvantage that after such an exceeding of torque an exchange of the pins is necessary.

In a particularly simple variant embodiment, two coupling elements have respectively detent elements, for example tooth systems, via which they engage into one another and can transfer a torque. The use of coupling discs is conceivable which lie on one another and are situated in engagement in normal operation. At least one of the coupling discs is acted upon here with a restoring force, for example by a plate spring. If the torque threshold value is exceeded, the coupling discs overcome the restoring force, twist with respect to one another over flanks of the tooth systems and are, in so doing, finally brought out of engagement. The torque can no longer be transferred and the coupling discs slip over the tooth systems until the torque abates again and the detent elements come into engagement again.

In a further advantageous embodiment, the coupling device is constructed as a blocking body coupling. This means that additional bodies are arranged between the coupling elements, which transfer the torque. For example, this may be balls, pins or claws which, on reaching the threshold torque, slip out from corresponding grooves and thus permit a twisting of the coupling elements.

Basically it is possible to construct the coupling device such that it only uncouples in one rotational direction, but blocks in the other rotational direction. This is able to be achieved for example for the configuration of the tooth flanks or in the case of a blocking body coupling of the grooves. In the latter case, the blocking body, for example the ball, can only be moved in one rotational direction on a flank of a depression or groove; in the other rotational direction the flank is embodied for example such that it blocks the movement of the ball.

The rotary column itself is rotatably mounted, preferably also in the same retaining component which also supports the drive unit. Through the use of a conventional joint bearing for mounting the rotary column, the latter can rotate in the retaining component and at the same time can compensate position deviations between upper and lower bearing in the X and Y direction. The pivot point of the guide shaft and the rotary column bearing should lie here on a plane, i.e. be arranged approximately at the same position of the rotational axis Z-Z. This prevents tensions and stresses of the bearings and causes the movement of the drive unit and rotary column to run as parallel as possible.

A ball shaft joint bearing has proved to be a particularly suitable bearing. The guide shaft is guided by means of balls in a ball mount. Ball-shaped depressions are arranged in the guide shaft, which hold the balls in position. Corresponding elongated depressions are provided in the Z direction in the ball mount, in which the balls are guided. Through the position of the elongated guides in the Z direction, the rotary movement about Z is prevented, but at the same time a tumbling motion about Z-Z or respectively a combined rotation about X and Y is enabled. The ball mount can preferably be constructed in two parts.

The guide shaft can preferably have a continuous bore running along its longitudinal axis, through which the necessary cables and similar connections can be guided. Such a bore has the advantage that on the one hand the utilization of space is optimized, and on the other hand cables and connections which are guided therein are protected.

The drive unit can be constructed and arranged differently. For example, the gear unit can be connected with the bearing via its output shaft as the guide shaft; however, an arrangement is also conceivable in which the output shaft of the drive motor, as guide shaft, is securely connected with the bearing. In the latter case, the housing of the gear unit, e.g. a planetary gear unit, is also securely connected with the rotary column. Basically, in contrast to the first variant embodiment, the drive unit is merely rotated, so that the gear unit points in the direction of the underlying base. When current is supplied to the drive motor, the housing of the drive unit rotates, whereby the rotary column is set into rotation. In this embodiment, an outer tube for the drive unit and the torque support in the region of the bearing can be dispensed with.

A non-self-locking drive unit or respectively a non-self-locking gear unit, preferably a reduction gear unit, can be provided; the blocking is therefore not to be provided by the drive unit or respectively the gear unit, but rather by a blocking device. A manual actuation of the entrance and exit devices is always ensured in an emergency, owing to the weak self-locking; for this, only the blocking action of the blocking device has to be cancelled. This leads to a high degree of safety.

As a self-locking of the drive or respectively of the gear unit is not provided, an additional blocking of the drive is imperatively necessary. This can take place by an additional braking device, which in the state when not supplied with current brings about a mechanical locking of the drive. This brake is able to be released electrically and manually by hand, in order to uncouple the drive and hence enable an electrical and/or manual operation. The manual release of the brake can take place via a known spring-loaded brake with manual lifting, wherein the manual lifting of the brake can be utilized for a mechanical emergency release device. Such brakes are known by the term “low active brake”. Alternatively, however, any other suitable blocking device is able to be used. The brake can, for example, act on the drive shaft of the drive motor by means of elastic force and be electromagnetically releasable.

The use of a so-called high active brake is also possible in accordance with the invention. Such a brake is also known under the term armature force brake. This means that the brake is active in the state when supplied with current, and the door is fixed in this position. The precondition here is that the entry door is provided with an external locking device, in order to permanently lock the entrance securely when a vehicle is parked for a lengthy period. This can take place e.g. by a remote-controlled central locking system.

In accordance with the invention, a brake as blocking device can even be dispensed with entirely, if the drive motor can be short-circuited. The door can thus be kept locked and a movement of the door can be prevented by means of the short-circuit torque of the drive motor which occurs. This function is always guaranteed, even if the vehicle is stationary and is not in operation. If the emergency release is actuated, the connection between the two contacts of the motor is interrupted, preferably via a mechanical switch, the short-circuit torque is cancelled and the door can be easily opened by hand without difficulty. The self-locking of the door is therefore cancelled by simple separation of the plus or minus line of the motor. The locking action is always present in the currentless state of the motor, i.e. a power failure has no altering effect on this. In the case of power failure or electronic system failure, the emergency unlocking can always take place by actuation of the short-circuit switch. It is possible to lock the entrance and exit device again, in particular a door, after interruption of the short-circuit by switching the switch back.

The short-circuit switch functions in accordance with the invention preferably directly without auxiliary energy and hence also in the case of an inoperative vehicle or in the case of interruption of current. The advantages of the use of such a short-circuit switch lie on the one hand in the reduction of the necessary components for the emergency release, and on the other hand the short-circuit switch can be placed at any desired ergonomically favourable location; the laying of otherwise usual Bowden cables or pneumatic lines is dispensed with.

In accordance with the invention also a combination of a locking on the basis of a short-circuit and the use of a brake or mechanical locking is possible. This can be the case in particular when the short-circuit torque is not sufficient to lock the door securely.

The switchable short-circuit can advantageously be ensured by special windings of the motor windings, which are provided exclusively for the production of the short-circuit. Through special windings, an increased braking action or respectively locking action can also be achieved.

Furthermore, the output element of the reduction gear unit can be connected with a lift-and-turn unit, a component which is known per se, which is used in particular in outward-swinging doors. By lifting the door, a form-fitting connection takes place of the door leaf with the door portal by means of lock strikers.

Instead of a non-self-locking drive unit, a self-locking embodiment is of course also able to be used. The overall reduction gear unit can be divided, for example, into two individual gear units, which are coupled with one another by a coupling device which is able to be disengaged. The controllable coupling device can be constructed as a coupling device which is able to be engaged under elastic force and which is connected to a manually actuatable emergency release device.

In a particularly advantageous embodiment, the first reduction gear unit is connected with the drive motor and the first coupling half jointly axially by means of elastic force of a compression spring with the second coupling half and the second reduction gear unit. In this embodiment, the construction on the coupling device is markedly simple and is able to be realized with distinctly fewer components. The external diameter also remains distinctly smaller, because the connection point of the Bowden cable is provided centrally in the housing.

When the coupling device is configured in accordance with the invention as a blocking body coupling, a support element can be connected in a form-fitting manner with the drive unit and fastened via a coupling bearing rotatably on a retaining component which is securely connected with the vehicle. The support element has axially-running depressions in which coupling balls are mounted. The coupling balls extend respectively into axially-running guides of the bearing housing, whereby a torque can be transferred. The bearing housing is securely connected with the retaining component of the vehicle, the coupling balls are held in position by a pressure disc during normal operation, wherein the pressure disc itself is in turn acted upon by an elastic force. It has proved to be particularly advantageous to use as flat a plate spring as possible, because the latter has a very flat force characteristic.

Alternatively the support element can also be formed by a plate-shaped component with depressions in which the balls are mounted. Such a plate-shaped component is able to be produced easily and at a favourable cost.

In normal operation, the coupling balls remain in the depressions and guides through the elastic force, but if the torque exceeds the threshold value, the balls move along lateral flanks of the depressions in axial direction, whereby the support element and hence the drive unit together with the rotary column rotates. A rotation can take place here up to the next recess, into which the ball is pressed owing to the restoring force of the spring.

The threshold value, i.e. the torque at which the balls can move out from the depressions, can be determined via the extent of the force of the plate spring set and via the angle of the lateral flanks of the recesses. Likewise, the permissible path on exceeding the threshold value can be predetermined by the number of recesses. In a particularly advantageous variant embodiment, eight recesses are provided with eight balls over 360°, whereby a path of 45° results.

Furthermore, a monitoring element can be provided, which registers an uncoupling of the coupling device. A switching element is conceivable which engages in recesses of the support element and thus is actuated by a rotation of the support element. The emitting signal can for example give the driver feedback about vandalism, or can be otherwise utilized in the door control system.

In a particularly advantageous variant embodiment of the invention, the bearing, which is arranged directly on the retaining component, can have in total three ball joint bearings. The first pivot bearing is in alignment with the rotational axis Z-Z and permits a pivoting out of the rotary column from the vertical in all directions. To transfer the torque, a torque support is provided, which also prevents a twisting of the coupling device about the rotational axis Z-Z. The torque support has two further ball joint bearings, which are arranged outside the rotational axis Z-Z and are connected via an intermediate element with an exterior of the coupling device. By means of the coupling device, the drive torque is directed via the torque support into the retaining component and from there on into the portal.

All three bearings are embodied as ball joint bearings, so that despite impeding of the rotary movement of the coupling device by the torque support, a pivoting or tumbling motion of the rotary column is possible in all directions. The ball joint bearings arranged in the torque support are advantageously arranged such that the rotation axes of all three bearings are arranged approximately at the same height or respectively in a horizontal plane. Hereby, unfavourable lifting conditions are avoided and optimum force conditions are ensured. Basically, however, a displacement of the pivot bearings with respect to their height is also possible.

Beneath the first ball joint bearing, which is in alignment with the rotational axis Z-Z, in accordance with the invention the coupling device is provided which receives on its side facing away from the bearing an output shaft of a gear unit which is connected with the coupling device via a toothed shaft mount in a torque-proof manner, but displaceably in the longitudinal direction of the rotary column, i.e. along the rotational axis Z-Z. The shaft mount itself is rotatably mounted in a further mount surrounding the shaft mount, which further mount in turn is positioned rotatably in a bearing sleeve of the drive device.

The mount is connected securely with an outer tube or respectively with the rotary column itself, the bearing sleeve serves for balancing out the pipe diameter between the internal diameter of the outer tube or respectively the rotary column and the external diameter of the mount. The bearing sleeve is screwed to the outer tube or respectively the rotary column and is embodied so as to be exchangeable as a wearing part.

The entire coupling device is displaceable via the output shaft and the shaft mount axially along the rotational axis Z-Z, which enables a length adjustment of the entire rotary column with the drive device.

Proceeding from the coupling device, the gear unit of the drive device adjoins below via the motor shaft. The motor and a brake follow. Advantageously, a further, simpler constructed gear unit can in addition adjoin the brake, which gear unit is connected with an encoder for a rotation path registration, for example an incremental or absolute encoder.

BRIEF DESCRIPTION OF THE DRAWINGS

The invention is explained in further detail below with the aid of the enclosed drawings.

In the drawings there are shown.

DETAILED DESCRIPTION OF EMBODIMENTS OF THE INVENTION

Figure 1:
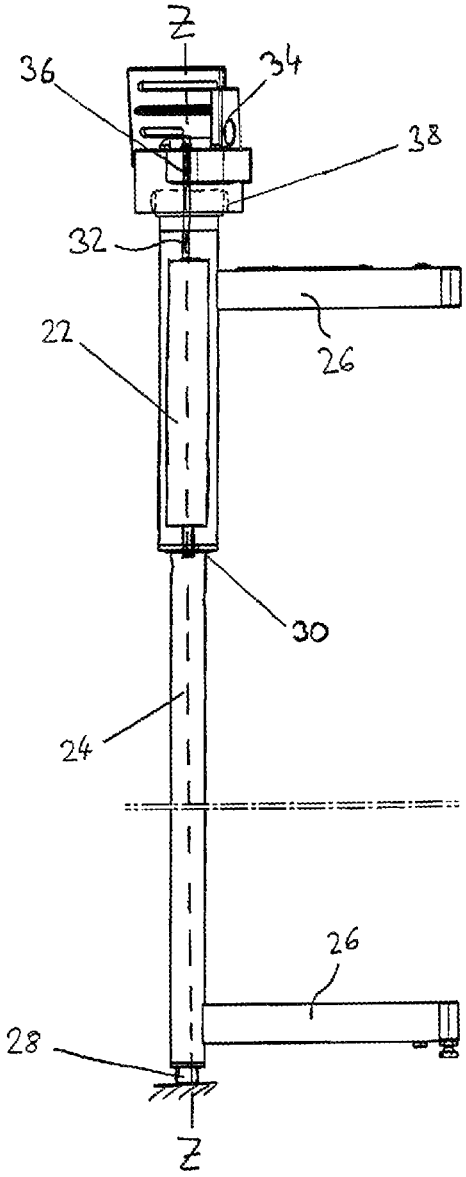
FIG. 1: a schematic diagram of a drive device.

FIG. 1 shows in a simplified schematic diagram a drive device 20. A drive unit 22 is accommodated in a rotary column 24. The rotary column 24 has holding arms 26 for fastening a door, which is not shown, and is mounted via a base bearing 28 rotatably on an underlying base, usually a vehicle floor. In addition, a pivot bearing 38 is shown, via which the rotary column 24 is mounted rotatably about a longitudinal axis Z-Z in a bearing 34.

The drive unit 22 is connected via a rotary column bearing 30 in a torque-proof manner with the rotary column 24, so that via the rotary column bearing 30 a rotary movement of the rotary column 24 can be brought about. A guide shaft 32 extends from the drive unit 22 into the bearing 34 and is connected via a drive unit bearing 36 in a torque-proof manner therewith. The drive unit bearing 36 can be embodied for example as a ball shaft joint bearing and serves to receive the torque of the drive unit 22, which in turn is securely connected with a retaining component 40 (cf. FIGS. 4 and 5).

Figure 2:
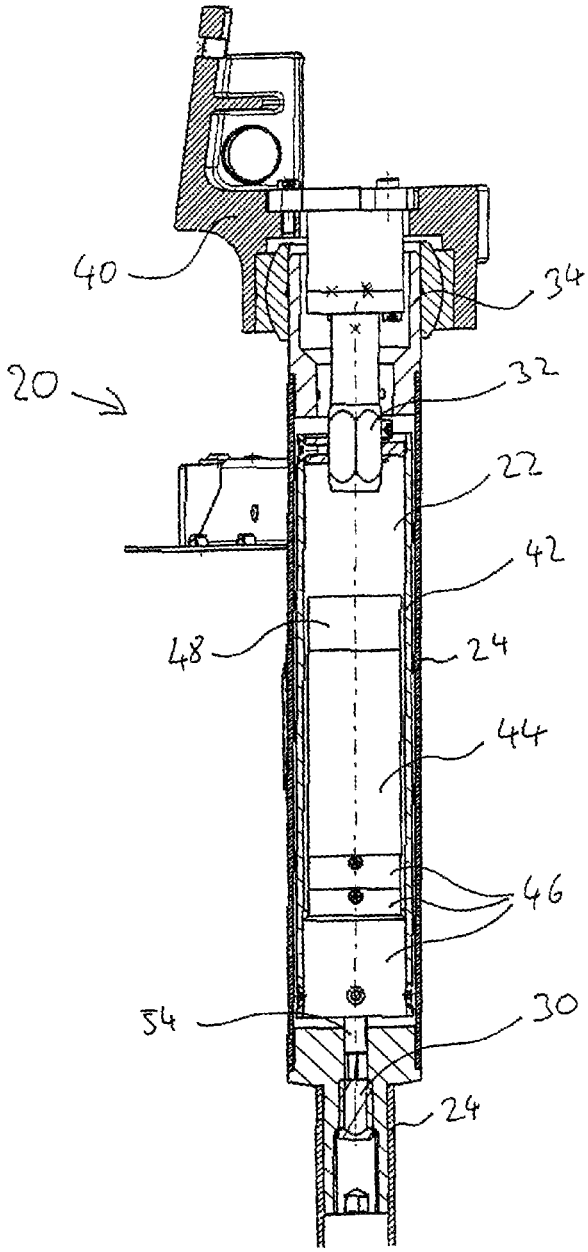
FIG. 2: a diagrammatic axial section of a first example embodiment of a drive unit for entrance and exit devices (without coupling)

FIG. 2 shows a drive unit 22, constructed as a compact drive and arranged in the rotary column 24, for example for a passenger door, in which inside a slim housing 42, constructed in a tubular shape, an electric drive motor 44 and a gear unit 46, preferably designed as a reduction gear unit, illustrated as a three-part planetary gear unit, are arranged one behind another in axial direction. Adjoining the drive motor 44 is a brake 48, which is likewise accommodated inside the housing 42 and can be embodied as a "low active brake", engaging under elastic force and releasable electromagnetically and mechanically, or as a "high active brake". The gear unit 46 is embodied so as to be self-locking.

An output element, which can not be seen, of the drive motor 44 is connected with an input element, which likewise can not be seen, of the gear unit 46, the output shaft 54 guide shaft 32 of which is connected via the rotary column bearing 30 with the rotary column 24. The rotary column 24 tapers beneath the drive unit 22.

The guide shaft 32 extends out from the housing 42 into the bearing 34, wherein the bearing is connected with the retaining component 40 of the vehicle.

The torque generated by the drive motor 44 is transferred via the gear unit 46 to the gear unit output shaft 54. In an emergency, the brake 48 merely has to be released, after which the manual actuation of the passenger door is readily possible owing to the absence of self-locking of the gear unit 46.

Instead of or in addition to the brake 48, a short-circuit device can also be provided for locking, which short-circuits the motor windings of the drive motor 44 for locking.

All the electrical and mechanical connection elements, e.g. if applicable a Bowden cable for the manual releasing of the brake, are arranged inside the housing 42. Also with the use of the drive device 20 in a lift-and-turn unit a sensor can be provided for lift detection.

Figure 3:
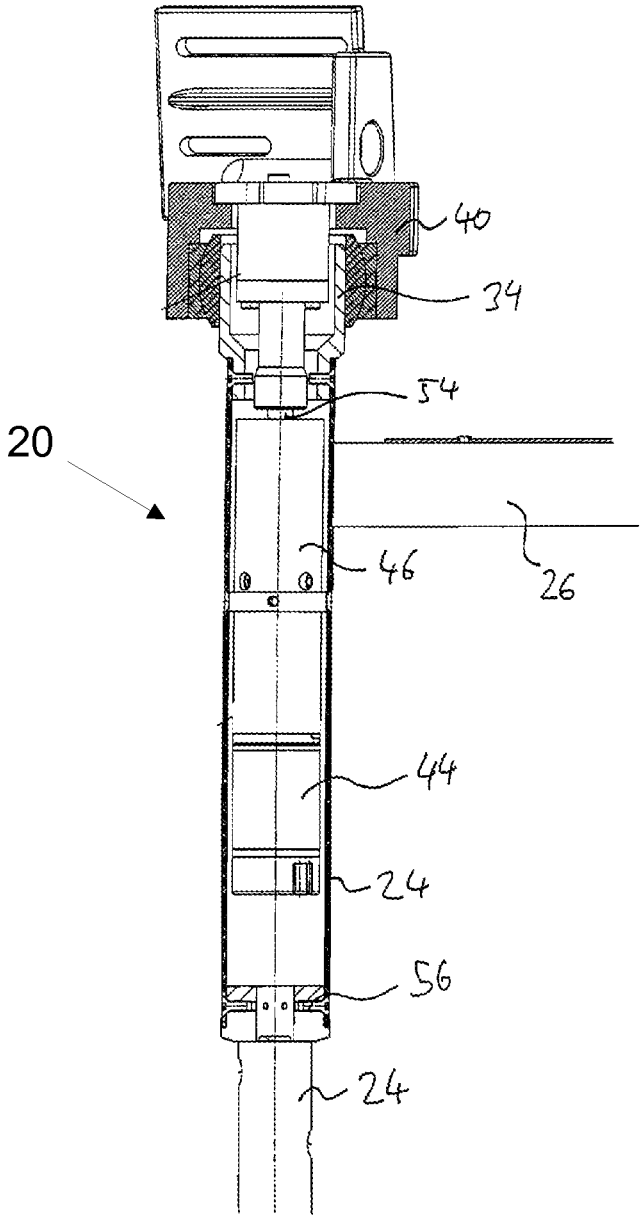
FIG. 3: a sectional illustration of a second embodiment of the mounting of the drive device (without coupling)

FIG. 3 shows a second example embodiment of the drive device 20; a coupling device 72 is not shown. In this case, the gear unit output shaft 54 acts as guide shaft 32, projects into the bearing 34 and is mounted there in a torque-proof manner. The housing of the planetary gear unit 46 is connected in a torque-proof manner with the rotary column 24. When the drive motor is provided with current, the housing of the planetary gear unit 46 of the drive unit 22 also rotates, whereby the rotary column 24 is set in rotation. In this embodiment, an outer tube 42 (cf. FIG. 2) can be dispensed with.

Figure 4:
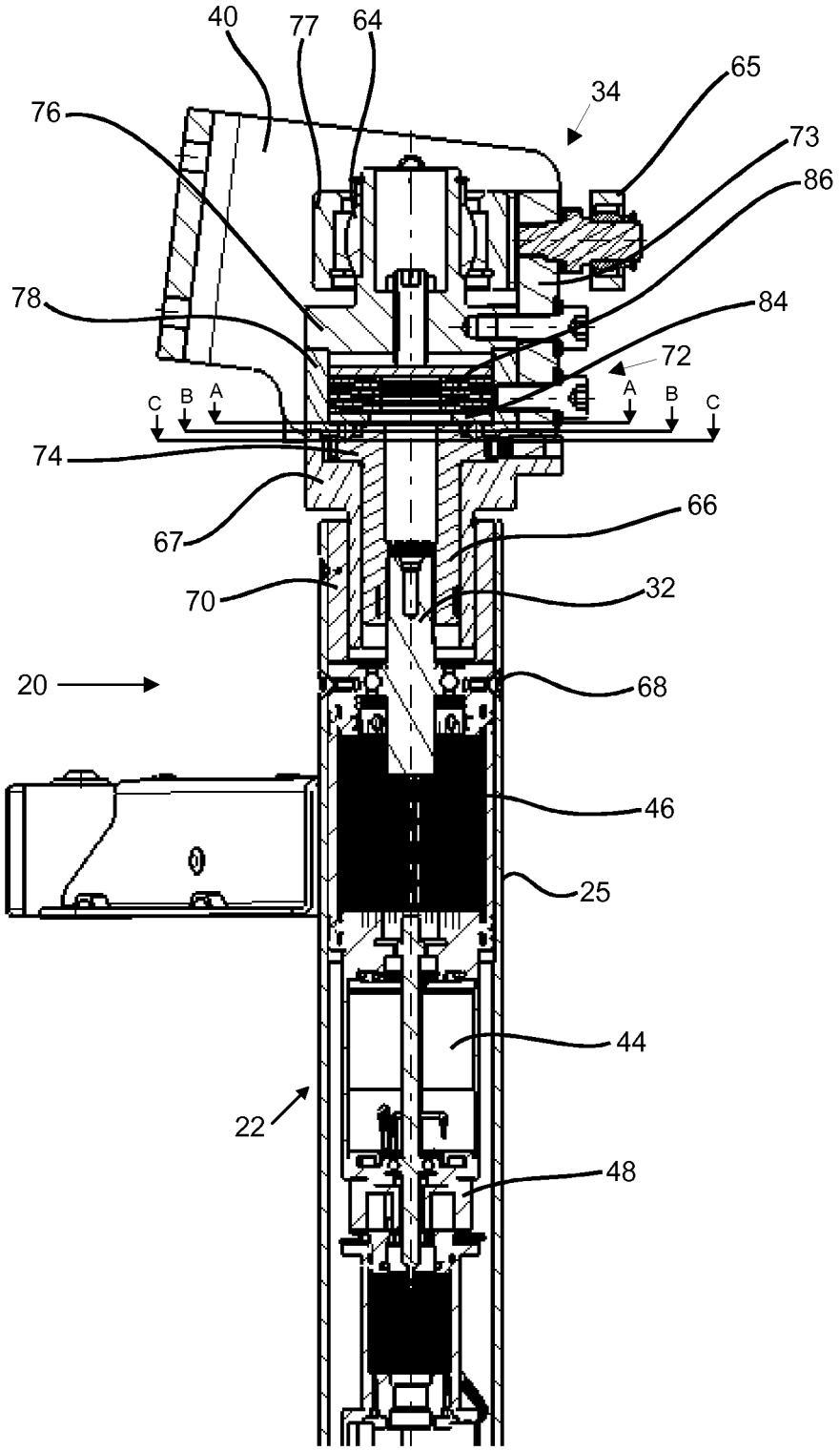
FIG. 4: a sectional illustration of a mounting of the drive devices with a coupling device according to a first embodiment of the invention.
Figure 5:
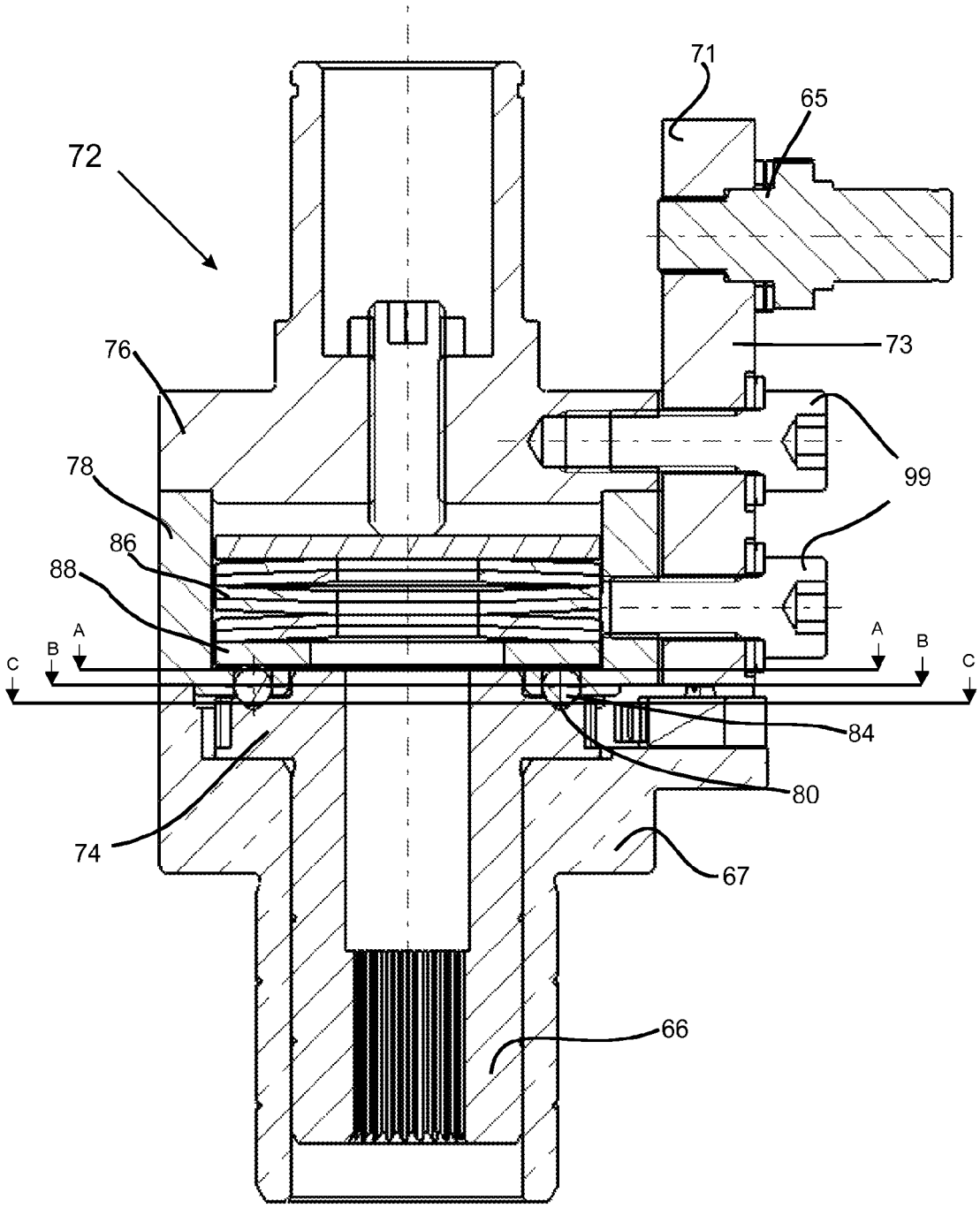
FIG. 5: an enlarged illustration of the coupling region of FIG. 4, FIG. 6: a partial perspective illustration of a drive device according to the embodiment of the invention of FIG. 4, with coupling.
Figure 6:
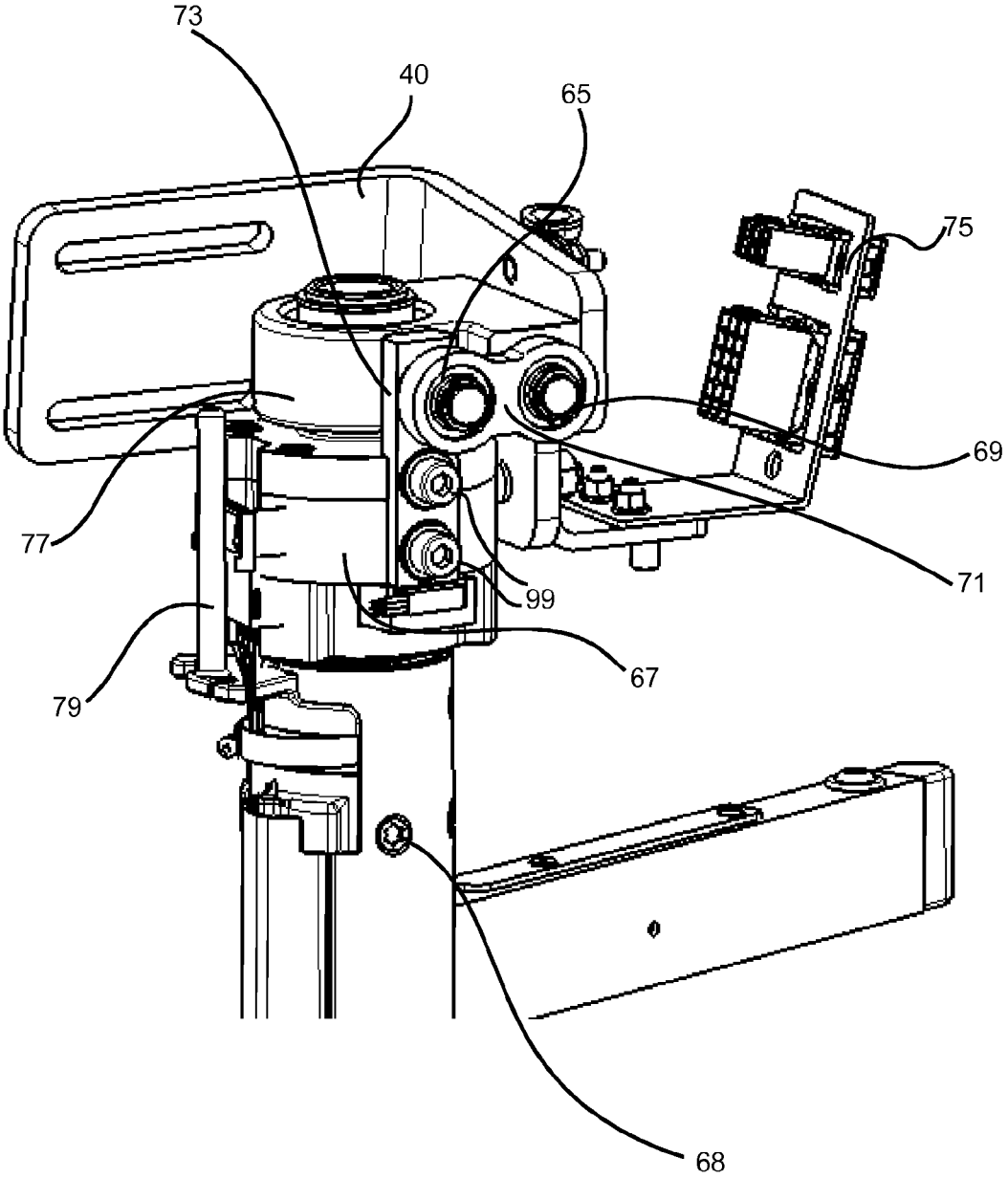

FIGS. 4, 5 and 6 show a first embodiment the coupling device of the invention with the mounting of the drive unit 22 on the retaining component 40 via the bearing 34, wherein in FIG. 5 the coupling region is illustrated on an enlarged scale. The mounting in accordance with the invention of the rotary column 24 takes place via the first joint bearing 64, in which the rotary column 24 can rotate about the longitudinal axis Z-Z and can balance out tumbling motions. In order to enable a displacement of the drive unit 22 in the Z direction during the tumbling motion, the guide shaft 32, which is displaceably mounted in a shaft mount 66 in the Z direction, transfers the torque of the drive unit 22, however, over a non-round outer contour.

The shaft mount 66 is rotatably mounted in a further mount 67, surrounding the shaft mount 66, which further mount in turn is positioned rotatably in a bearing sleeve 70 of the drive device 20. The bearing sleeve 70 is securely connected with an outer tube 25 of the rotary column 24. The bearing sleeve 70 serves for diameter equalization between the internal diameter of the outer tube 25 in this region and the external diameter of the mount 67 and is screwed to the outer tube 25 by means of screws 68.

A coupling device 72 is arranged beneath the first joint bearing 64 and is connected with the lower rotary column 24 via the shaft mount 66. The shaft mount 66 has in the further course a support element 74 with substantially horizontally arranged depressions 80, which are in alignment with recesses 82 which are arranged in a pressure disc 88 (cf. FIGS. 7 to 12). In the depressions 80 there are coupling balls 84, which serve for the transfer of the torque. In a coupling housing 78 in addition a plate spring 86 is arranged as a restoring force element, which via the pressure disc 88 exerts a force onto the coupling balls 84, and presses these into the depressions 80 or holds these there. Further details concerning the structure of the coupling device 72 emerge in particular from FIGS. 7 to 11.

The coupling housing 78 is connected with an inner bearing housing 76, which is also part of the first joint bearing 64. The first joint bearing 64 is surrounded by an outer bearing housing 77.

In addition to the first joint bearing 64, the bearing 34 has a second joint bearing 65 and a third joint bearing 69, which are arranged in a torque support 71. The two outer joint bearings 65, 69 are connected with the coupling device 72 via an intermediate element 73. A rotating of the coupling device 72 is effectively prevented by the torque support 71, but a tumbling motion of the rotary column is possible via the three joint bearings 64, 65, 69. The rotational axes of the three joint bearings 64, 65, 69 are arranged at a height or respectively in a plane which brings about a favourable relationship of forces.

In FIG. 6 in addition a plug device 75 can be seen, which serves for the connecting of electrical connection cables which are not shown. The connection cables can be fastened quickly and simply via a cable- or Bowden cable guide 79; also, conventional cable connectors can be used.

In FIGS. 4 and 5 in addition it can be seen that the intermediate element 73 and hence also the torque support 71 are connected via fastening screws 99 with the coupling device 72.

Adjoining the coupling device 72 in the direction pointing away from the retaining component 40 (downwards) is the gear unit 46, preferably designed as a reduction gear unit. There follow the drive motor 44 and the brake 48. In addition, a second gear unit 43 is illustrated, which is connected with an encoder, not shown, for a rotation path registration. The second gear unit 43 is a simple gear unit, produced for example from plastic, which does not serve for torque transfer, but rather only for rotation path registration. An incremental or absolute encoder is suitable for example as an associated encoder.

The sectional illustrations in FIGS. 7 to 11 clarify the structure of the coupling device 72. The support element 74 has axially-running depressions 80 which in normal operation are in alignment with likewise axially-running guides 82 which are arranged in the bearing housing 76. Coupling balls 84, which project into the guide 82 for the transfer of the torque, are situated in the depressions. In addition in the coupling housing 78 the plate spring 86 is arranged as restoring force element, which exerts a force via the pressure disc 88 onto the coupling balls 84 and presses these into the depressions 80 or holds these there.

Figure 7:
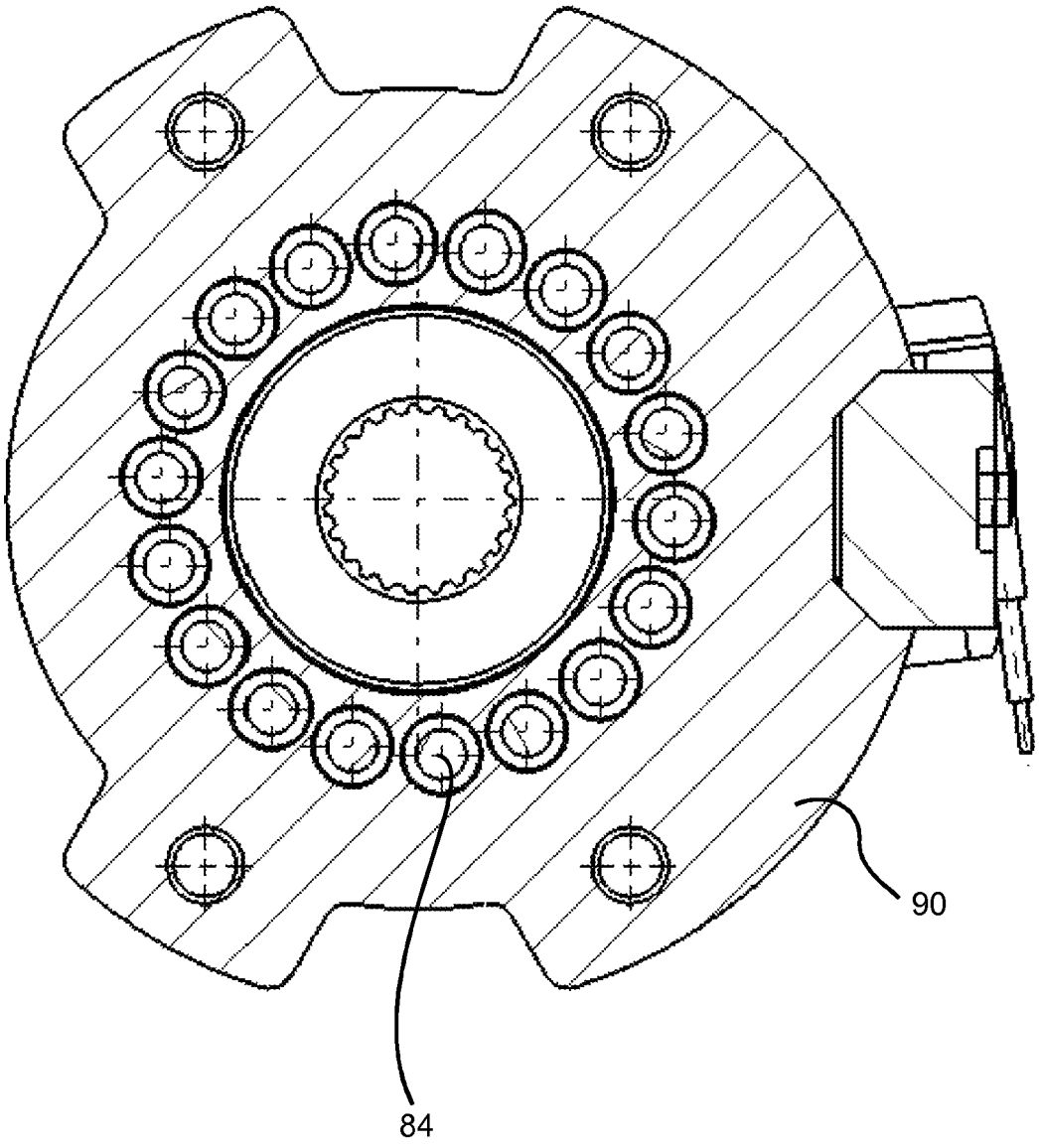
FIG. 7: a sectional illustration along the section line A-A of FIG. 5, FIG. 8: a sectional illustration according to section line B-B of FIG. 5, FIG. 9: a sectional illustration according to section line C-C of FIG. 5, FIG. 10: a first sectional illustration of an alternative embodiment to illustrate the functional principle of a coupling device in accordance with the invention.
Figure 10:
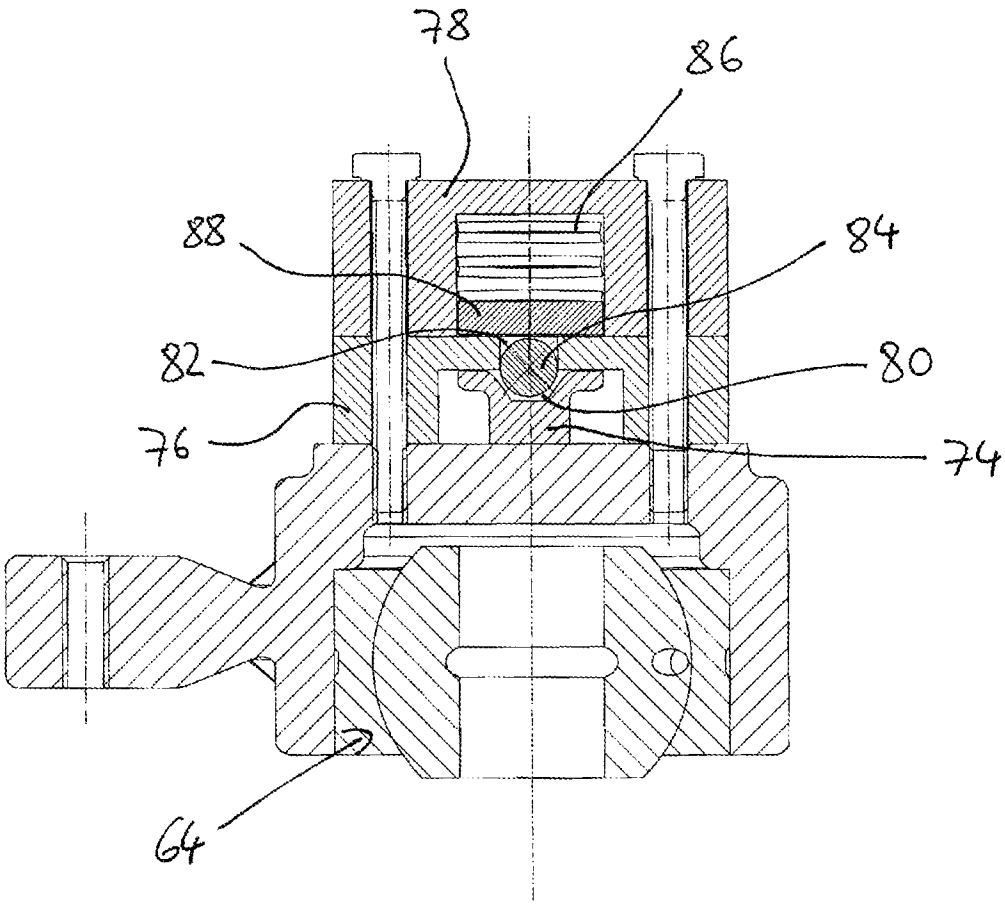

FIG. 7 shows that a horizontally-running ring section 90 projects between the coupling balls 84 and the pressure disc 88. As can be seen in FIG. 10, the guides 82 run axially through this ring section 90, so that the coupling balls 84 can come in contact with the pressure disc 88.

Figure 8:
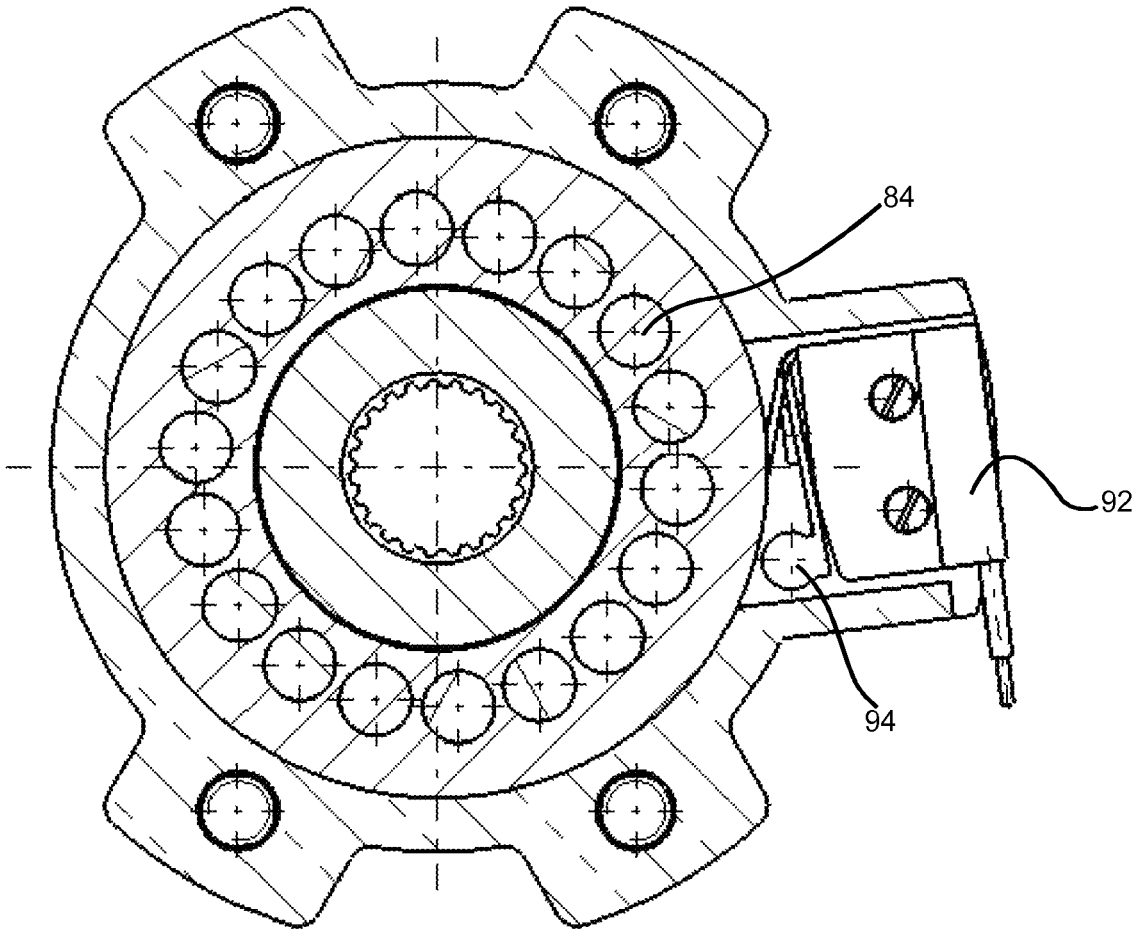
Figure 9:
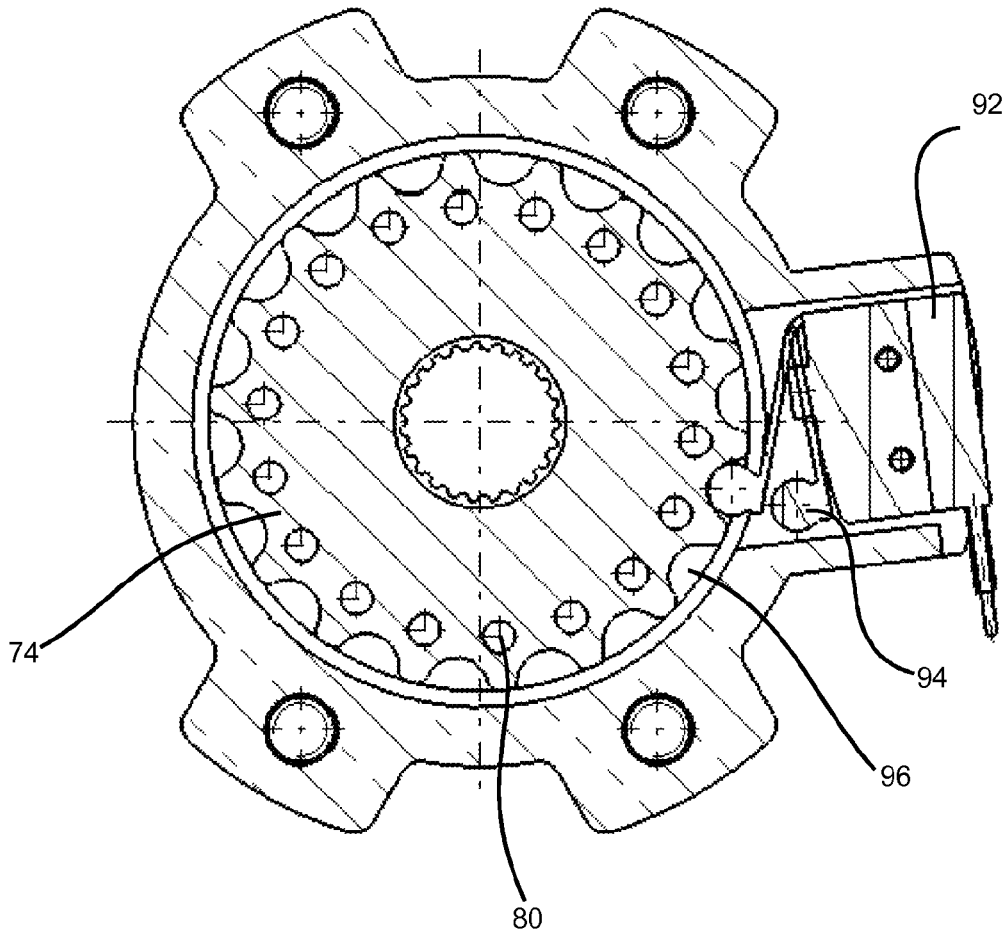

FIGS. 8 and 9 show a switching element 92 with a switching arm 94, which engages in recesses 96 arranged on the outer circumference of the support element 74. When the support element 74 rotates, the switching arm 94 is moved and the switching element 92 is switched. The signal connected therewith can, for example, provide a driver with feedback concerning vandalism or can be otherwise utilized.

Figure 11:
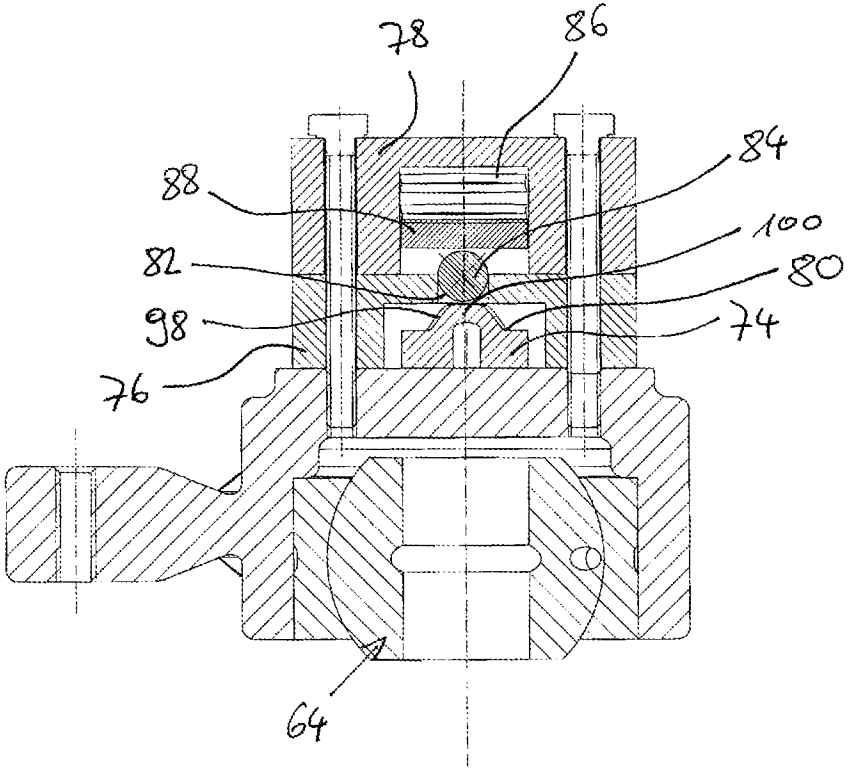
FIG. 11: a second sectional illustration of the embodiment of FIG. 10 to illustrate the functional principle of the coupling device of FIG. 10, FIG. 12: an exploded drawing of the drive device according to the invention.

FIGS. 10 and 11 illustrate in a greatly simplified schematic diagram the mode of operation of the coupling device 72 in an alternative embodiment of the invention. Inter alia a coupling ball 84 can be seen, which in the normal state according to FIG. 8 is arranged in a depression 80 and projects into the guide 82. The pressure disc 88 holds the coupling ball 84 in the depression 80.

FIG. 11 shows the state which results on exceeding of the threshold value of the torque which is applied. The support element 74 has rotated and the coupling ball 84 has been driven along a lateral flank 98 upwards in the direction of the pressure disc 88. The torque has exceeded the restoring force of the plate spring 86, whereby the coupling ball 84 has rolled in the guide 82 up to an apex 100 between two depressions 80. In this position, the support element 70 can rotate until the threshold value is fallen below again and the coupling ball 84 is pressed back into one of the following depressions 80.

Figure 12:
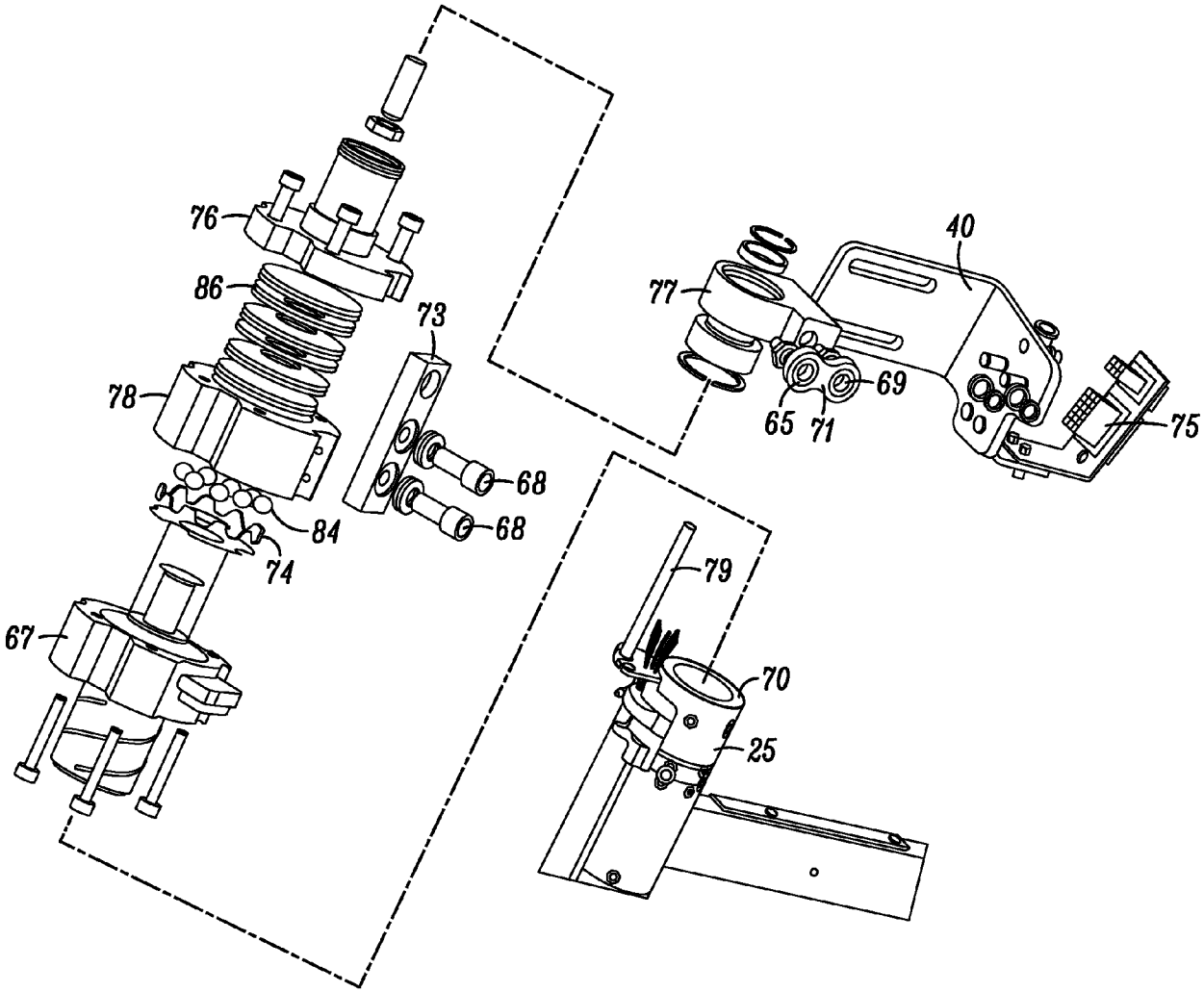

FIG. 12 illustrates the structure of the drive device 20 in an exploded illustration.

The invention is not limited to the described example embodiments, but rather also comprises further embodiments acting in an equivalent way. The description of the figures serves merely for an understanding of the invention.

What is claimed is:

1. A drive device for entrance and exit devices for public transportation vehicles, comprising:

a vehicle structure comprising a retaining component configured to hold a drive unit onto the vehicle and act as a counter bearing for torque applied to the drive unit;

a rotary column operatively coupled to the entrance and exit device of the vehicle;

the drive unit disposed within the rotary column and operatively connecting the rotary column to the retaining component and configured to drive the rotary column about a rotational axis Z-Z during opening and closing operations, said rotary column configured to open and close the entrance and exit device via rotation thereof;

a coupling device coupled between the drive unit and the retaining component configured to permit a rotation of the drive unit about the rotational axis Z-Z when a threshold value of the torque applied to the drive unit is exceeded, and a bearing disposed between the coupling device and the retaining component, (i) configured to permit a tumbling motion of the rotary column and the coupling device, the tumbling motion defining a deflection from the rotational axis Z-Z in at least one of an X direction or a Y direction, and (ii) configured to prevent a rotation of the coupling device about the rotational axis Z-Z.

2. The drive device according to claim 1, wherein the bearing has a first joint bearing in alignment with the rotary column.

3. The drive device according to claim 2, wherein the coupling device further comprises a torque support configured to connect the coupling device with the retaining component to secure the coupling device against twisting about the rotational axis Z-Z.

4. The drive device according to claim 3, the bearing further comprising a second joint bearing and a third joint bearing and configured to permit movements of the rotary column and of the drive unit.

5. The drive device according to claim 4, wherein the first, second and third joint bearings comprise ball joint bearings, the rotational axes of which all intersect a plane.

6. The drive device according to claim 1, wherein the coupling device comprises a blocking body coupling.

7. The drive device according to claim 6, wherein the coupling device comprises at least a first coupling element which is held in engagement with a second coupling element by a restoring force element, wherein a restoring force, which is applied by the restoring force element, is only overcome on exceeding of the threshold value of the torque acting on the drive unit and thereby the coupling elements are brought out of engagement.

8. The drive device according to claim 7, wherein the first coupling element comprises a support element having at least one axially-running first depression with lateral flanks running obliquely in a circumferential direction of the drive unit, the second coupling element comprises a bearing housing having at least one axially-running guide, and further comprising an axially-guided coupling ball disposed in the axial depression and projecting into the guide, and wherein the coupling ball, on a rotation of the drive unit, is moved via the obliquely-running lateral flank of the depression against the restoring force of the restoring force element.

9. The drive device according to claim 7, further comprising a pressure disc arranged between the coupling device and the restoring force element, wherein the restoring force element comprises a plate spring configured to act on the pressure disc.

10. The drive device according to claim 1, further comprising a guide shaft connected in a torque-proof manner with the drive unit.

11. The drive device according to claim 10, the drive unit comprising a drive motor, wherein the guide shaft defines an output shaft of the drive motor.

12. The drive device according to claim 10, wherein the guide shaft defines a gear unit drive shaft of the drive unit.

13. The drive device according to claim 1, wherein the coupling device further comprises a torque support configured to connect the coupling device with the retaining component to secure the coupling device against twisting about the rotational axis Z-Z.

* * * * *